US006691622B2

(12) United States Patent
Zavitsanos et al.

(10) Patent No.: US 6,691,622 B2
(45) Date of Patent: Feb. 17, 2004

(54) REACTIVE PROJECTILES, DELIVERY DEVICES THEREFOR, AND METHODS FOR THEIR USE IN THE DESTRUCTION OF UNEXPLODED ORDNANCE

(75) Inventors: Peter D. Zavitsanos, Gwynedd Valley, PA (US); Charles W. Files, Perkasie, PA (US); Dmitri Bohn, Green Lane, PA (US)

(73) Assignee: General Sciences, Inc., Souderton, PA (US)

( * ) Notice: Subject to any disclaimer, the term of this patent is extended or adjusted under 35 U.S.C. 154(b) by 0 days.

(21) Appl. No.: 10/238,676

(22) Filed: Sep. 10, 2002

(65) Prior Publication Data

US 2003/0070540 A1 Apr. 17, 2003

Related U.S. Application Data

(63) Continuation-in-part of application No. 09/586,379, filed on Jun. 2, 2000.

(60) Provisional application No. 60/190,829, filed on Mar. 21, 2000.

(51) Int. Cl.[7] ..... F42B 12/36

(52) U.S. Cl. ..... 102/364; 102/517; 102/478; 102/519

(58) Field of Search ..... 102/703, 364, 102/473, 517, 518, 519, 477, 478, 499; 86/50

(56) References Cited

U.S. PATENT DOCUMENTS 3,158,991 A 12/1964 D'Alelio
3,257,801 A * 6/1966 Martinez ..... 60/219
3,565,706 A * 2/1971 Waite ..... 149/19.3
3,677,181 A * 7/1972 Giljarhus et al. ..... 102/364
3,677,182 A * 7/1972 Peterson ..... 102/517
3,865,035 A 2/1975 Munson et al.
3,960,083 A 6/1976 Dietzel et al.
3,983,818 A * 10/1976 Ciccone et al. ..... 102/364
3,992,996 A * 11/1976 Strandli ..... 102/364
4,402,705 A * 9/1983 Daume et al. ..... 149/19.91
4,419,936 A * 12/1983 Coates et al. ..... 102/364
5,529,649 A 6/1996 Lund et al.
5,859,383 A 1/1999 Davison et al.
5,929,370 A 7/1999 Brown et al.
5,988,038 A 11/1999 Feintuch

OTHER PUBLICATIONS

"Jane's Mines and Mine Clearance", Editor: Colin King, Fourth Ed., 1999–2000.

* cited by examiner

*Primary Examiner*—Michael J. Carone
*Assistant Examiner*—Gabriel S. Sukman
(74) *Attorney, Agent, or Firm*—RatnerPrestia

(57) ABSTRACT

A projectile for the destruction of unexploded ordnance comprising a projectile shell having a core region which contains a reactive composition comprised of a reactive metal and an oxidizer. The reactive metal is selected from the group consisting of titanium, aluminum, magnesium, lithium, beryllium, zirconium, thorium, uranium, hafnium, alloys thereof, hydrides thereof, and combinations thereof. The oxidizer is selected from the group consisting of lithium perchlorate, lithium chlorate, magnesium perchlorate, magnesium chlorate, ammonium perchlorate, ammonium chlorate, potassium perchlorate, potassium chlorate, oxides thereof, peroxides thereof, and combinations thereof. Also included are methods of destroying unexploded ordnance and disposable apparati for delivering a projectile to destroy unexploded ordnance.

6 Claims, 17 Drawing Sheets

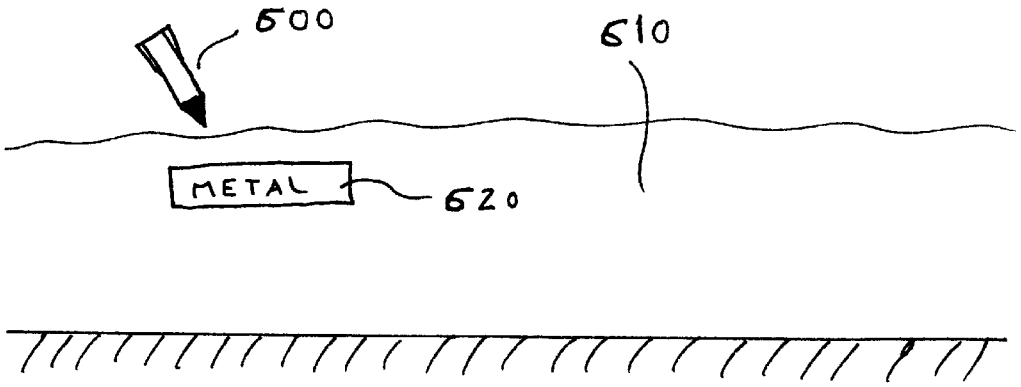
(Prior Art) Fig. 5a
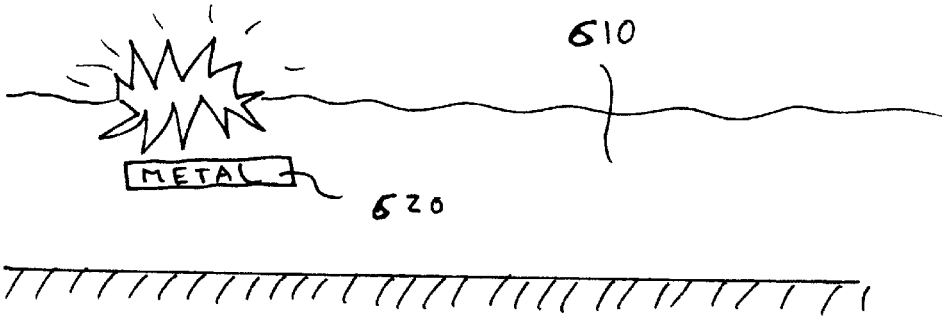
(Prior Art) Fig. 5b
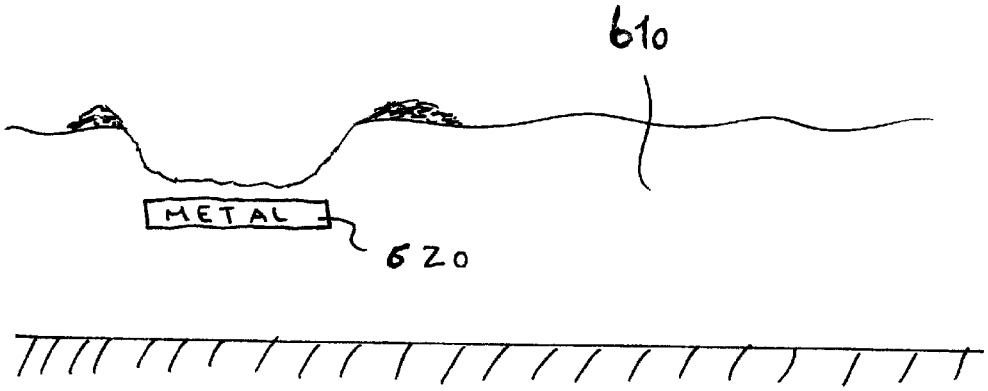
(Prior Art) Fig. 5c

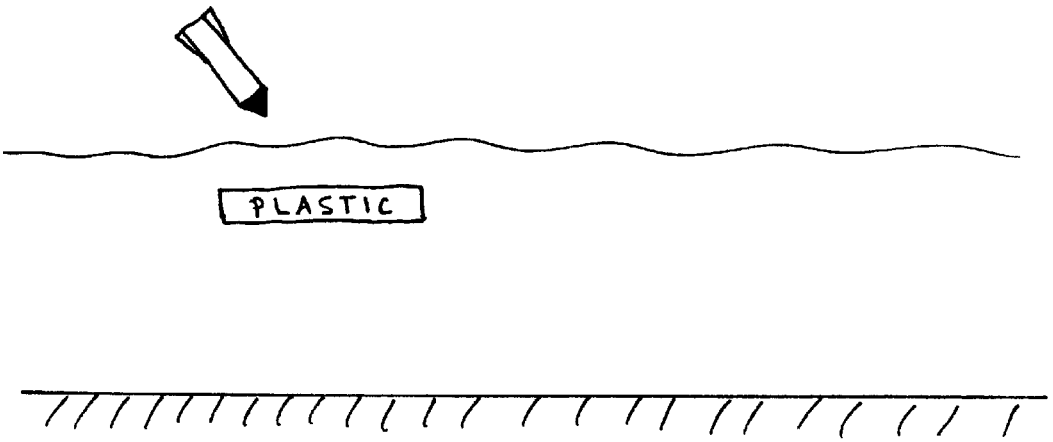
(Prior Art) Fig. 6a
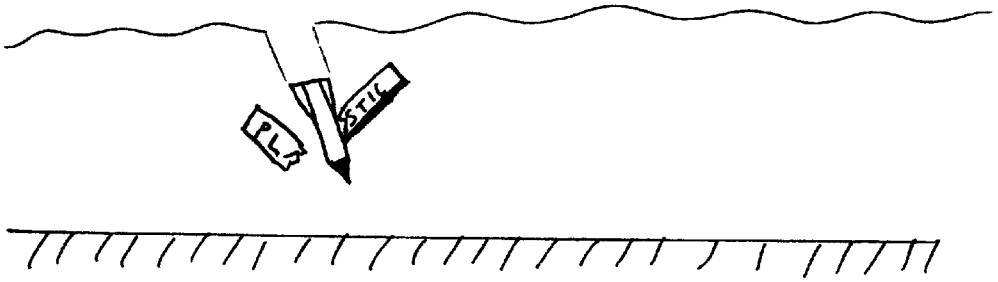
(Prior Art) Fig. 6b
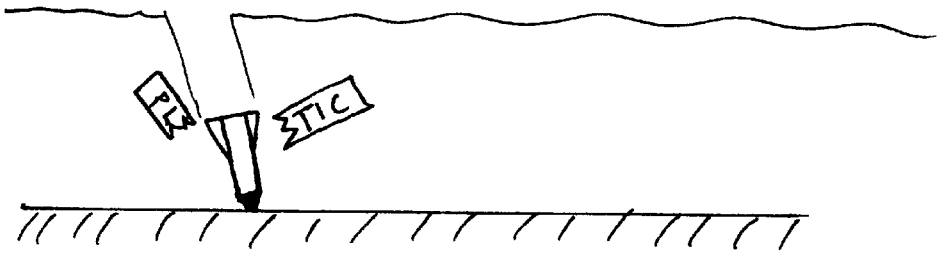
(Prior Art) Fig. 6c

REACTIVE PROJECTILES, DELIVERY DEVICES THEREFOR, AND METHODS FOR THEIR USE IN THE DESTRUCTION OF UNEXPLODED ORDNANCE

This application is a Continuation-in-part application of U.S. patent application Ser. No. 09/586,379 (pending), filed Jun. 2, 2000, which claimed the benefit of earlier-filed U.S. Provisional Application Ser. No. 60/190,829 filed on Mar. 21, 2000, the content of both of which is incorporated by reference herein.

The U.S. Government has a paid-up license in this invention and the right in limited circumstances to require the patent owner to license others on reasonable terms as provided for by the terms of Contract No. N00024-99-C-4009 awarded by the United States Navy.

FIELD OF INVENTION

This invention relates generally to the destruction of unexploded ordnance, and more specifically to the destruction of land and sea mines.

BACKGROUND OF THE INVENTION

The elimination of unexploded ordnance (e.g. mines) from land, beaches, or sea water presents a serious problem for both military personnel and civilians. Serious humanitarian overtones exist and many methods and techniques have been devised to deal with this problem.

Detection is the first step, which is typically handled by a variety of sophisticated techniques. Once the mines are located, however, the demining activity begins and presents serious dangers. Several methods are used to actually demine an area, including: (1) using rakes, plows, or rollers to actually detonate the mines; (2) detonating explosives on top of the mine (either on the dirt above the mine or on the exposed mine itself) to cause the detonation of the mine (usually the explosives are placed on top of the mine by a boom operated remotely or by a robot); or (3) exposing the mine (i.e. by removing dirt, in the case of a land mine) and placing a flare device on top of the mine. In the case of using the flare device, the flare device causes heating from outside of the mine which eventually causes the mine's destruction through detonation or burning.

Demining in the above-described conventional ways involves open detonation of explosives (in addition to the mine itself) which introduces hazards to people, personal property, and land. These collateral risks are undesirable for obvious reasons, including the destruction of land which the military may wish to use for transport. This is especially true when the military is demining a road as it travels toward on objective. An additional problem seen with conventional mine destruction techniques, particularly on land, involves the introduction of additional metallic debris from the mine and/or the detonation device which subsequently interferes with additional mine detection, creating false positive readings of additional mines when metal detectors sweep an area.

Several, more recent, attempts have been made which utilize the use of an inert high velocity projectile which impacts the mine causing its detonation. These efforts have generally failed because of the very high velocities necessary to cause initiation of the mine. This is especially true when the mine is comprised of trinitrotoluene (TNT), which typically requires impact velocities above 3,500 feet/second. It is especially difficult to achieve these high velocities when the projectile must travel through water or dirt in order to reach the mine.

Other, related, technologies have included an attempt at introducing reactive materials or oxidizers to the TNT charge in an effort to cause its explosion. Typically, however, without enough oxygen (in the case of the delivery of reactive materials) or without a source of ignition (in the case of delivery of an oxidizer), the TNT was not effectively or regularly destroyed.

Another problematic area regarding prior art methods and devices concerns the fact that they are "mine-specific". By this, it is meant that different devices and methods were developed for the destruction of different types of mines. For example, plastic mines that are buried in sand or soil required different devices for destruction as compared to metal mines similarly situated. More specifically, if a mine destroying shell is designed to ignite or explode at a particular impact force, it may ignite or explode upon impact with the soil. This might be allowable if an adjacent plastic mine is the target for destruction, but such "premature" ignition/explosion would not penetrate or destroy a metal cased mine.

If, on the other hand, the projectile's robustness was increased (increasing the required impact force to cause ignition or explosion), so that it would ignore the shock experienced upon impact with overburden, it could impact the overburden, penetrate the overburden and metal mine shell, and destroy the metal mine. But in this case the same projectile might impact and penetrate a plastic mine without ignition or explosion because an insufficient is impact force was felt by the device, and thus fail to destroy the plastic mine. Thus, these projectiles were essentially mine-specific, and the user had to know the type of mine before attempting to destroy it, and select a suitable projectile in accordance with that knowledge.

Therefore, it is an object of the present invention to provide an effective mine-destroying projectile that fully neutralizes a mine without introducing additional metal debris into the mined area. Another object of the present invention is to provide a projectile which is capable of penetrating water or dirt with enough residual velocity to still penetrate the mine shell or skin and cause its neutralization through fast deflagration. Still yet another object of the present invention is to provide a projectile which is not mine-specific. Yet another object of the present invention is to provide a delivery system for the projectile that does not introduce metal debris into the mined area.

SUMMARY OF THE INVENTION

The present invention provides a projectile for the destruction of unexploded ordnance comprising a reactive composition. The reactive composition comprises a reactive element or metal selected from titanium, aluminum, magnesium, lithium, beryllium, zirconium, thorium, uranium, hafnium, alloys thereof, hydrides thereof, and combinations thereof, and an oxidizer selected from lithium perchlorate, lithium chlorate, magnesium perchlorate, magnesium chlorate, ammonium perchlorate, ammonium chlorate, potassium perchlorate, potassium chlorate, oxides thereof, peroxides thereof, and combinations thereof, wherein the oxidizer is always present in a stoichiometric excess with respect to the reactive element or metal. Optionally included in the reactive composition is a binder. The most preferred metal is titanium and the most preferred oxidizer is potassium perchlorate ($KClO_4$).

The present invention also includes the use of reactive metals in combination with materials capable of exothermically reacting with the reactive metals to form intermetallic compounds which are then oxidized during the ordnance-destroying event. This aspect of the present invention is utilized in different embodiments, and generally includes the placement of the reactive metals in combination with materials capable of exothermically reacting with the reactive metals to form intermetallic compounds toward the front of the projectile, and the remaining reactive metals and oxidizers toward the rear of the projectile.

One such example of the present invention is a projectile for the destruction of unexploded ordnance comprising a head region comprising a first reactive composition and a body region disposed behind the head region comprising a second reactive composition. The body region contains an ignition device.

Another embodiment of the present invention for controlled destruction of unexploded ordnance is a reactive projectile comprising a head region having a first reactive composition and a body region disposed behind the head region comprising a second reactive composition. The body region contains a body region ignition device, wherein the body region explodes upon impact before the head region explodes.

Also included in the present invention is a two-component projectile for the destruction of unexploded ordnance comprising a head region shell and a body region shell. The head region shell has a head wall thickness, and contains a first reactive composition. The body region shell is disposed behind the head region and has a body wall thickness. The body region comprises a second reactive composition and a body region ignition device. The head wall thickness is greater than the body wall thickness.

The present invention also includes methods of destroying unexploded ordnance using the devices of the present invention. One such method comprises the steps of impacting unexploded ordnance with a projectile having a head region and a body region disposed behind the head region wherein the head region comprises a first reactive composition and the body region comprises a second reactive composition and a body region ignition device. In this method, the body region ignition device initiates an exothermic reaction of the second reactive composition before an exothermic reaction of the first reactive composition is initiated.

Also included in the present invention is an apparatus for launching a reactive projectile in accordance with the present invention. A part of the apparatus comprises a holding device which is comprised of a platform having a hole disposed therein, and at least three legs extending from the platform. The second part of the apparatus is a reactive projectile firing device comprised of a barrel having a top and a bottom and a middle region therebetween, and an end cap disposed at the top. Included is a suspension bracket extending radially outward from the middle region of the barrel, wherein the holding device is adapted to receive the reactive projectile firing device and suspend the reactive projectile firing device by the suspension bracket.

Another part of the invention includes a system for the destruction of unexploded ordnance comprising the apparatus described above in conjunction with a reactive projectile disposed within the reactive projectile firing device, and means to expel the reactive projectile from the firing device. An alternative embodiment of this aspect of the present invention utilizes a reactive projectile firing device having at least three legs attached directly to the outside of the barrel. The legs extend downward and beyond the end of the barrel to support the reactive projectile firing device atop a mine.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing may not be drawn to scale. Included in the drawing are the following figures:

FIGS. 5*a*–5*c* are a representation of a series of progressive events when a projectile according to the prior art is used;

FIGS. 6*a*–6*c* are an alternative representation of a series of progressive events when a projectile according to the prior art is used;

FIGS. 9*a*–8*d* are another representation of a series of progressive events when a projectile according to the present invention is used;

DETAILED DESCRIPTION OF THE INVENTION

Figure 1:
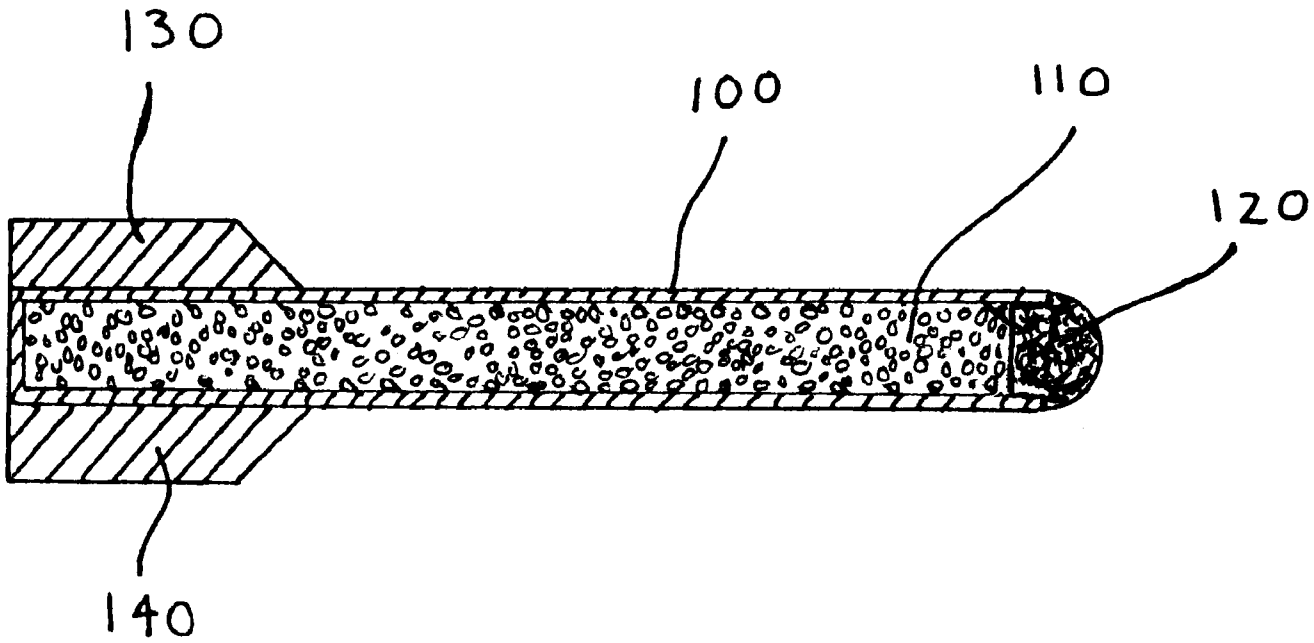
FIG. 1 is a cross sectional view of one embodiment of the projectile according to the present invention.

The invention provides a projectile for the destruction of unexploded ordnance comprising a projectile containing a reactive composition. The reactive composition is comprised of a metal selected from the group consisting of: titanium, aluminum, magnesium, lithium, beryllium, zirconium, thorium, uranium, hafnium, alloys thereof, hydrides thereof, and combinations thereof. The oxidizer is selected from lithium perchlorate, lithium chlorate, magnesium perchlorate, magnesium chlorate, ammonium perchlorate, ammonium chlorate, potassium perchlorate, potassium chlorate, oxides thereof, peroxides thereof, and combinations thereof, wherein the oxidizer is always present in a stoichiometric excess with respect to the reactive element or metal. The reactive composition may also include a binder, typically a polymer, and preferably a fluorinated polymer, such as Teflon ("Teflon" is a registered trademark of the E. I. Du PONT De NEMOURS AND COMPANY CORPORATION for fluorine-containing polymers).

The present invention also includes the use of reactive metals in combination with materials capable of exothermically reacting with the reactive metals to form intermetallic compounds which are then oxidized during the ordnance-destroying event. This aspect of the present invention is utilized in different embodiments, and generally includes the placement of the reactive metals in combination with materials capable of exothermically reacting with the reactive metals to form intermetallic compounds toward the front of the projectile, and the remaining reactive metals and oxidizers toward the rear of the projectile. Preferred among these materials are boron and carbon.

One embodiment of the present invention is a projectile comprising a shell that carries the reactive composition. A second embodiment is a projectile comprised itself of the reactive composition. Modifications of these two embodiments include various nose configurations and flexible constructions capable of penetrating several media (sand, soil, or water) to the required target depths with sufficient residual velocity to penetrate the mine. For all embodiments, however, the reactive composition is carried by the projectile to the mine and is then initiated. The initiation occurs upon impact with the mine either without a separate initiator or by separate initiator such as a pressure sensitive fuse or primer.

In the case where no separate initiator is used, the mechanical impact and subsequent deformation is relied upon to deliver sufficient energy to cause the initiation of the projectile's reactive materials. Alternatively, a separate initiator, such as a plunger or primer, can be placed in the nose of the projectile to initiate the reaction upon impact with the target. The former embodiment (no separate initiator) is generally preferred because of the increased risk of premature ignition where a separate initiator is used, particularly where the projectile must penetrate a large amount of overburden.

The reactive composition itself is generally comprised of a metal and an oxidizer. A preferred composition is a mixture of potassium perchlorate ($KClO_4$) and titanium. Although this is a preferred composition, many other exothermic mixtures consisting of a powdered mixture of metal and oxidizer would also provide a reaction scheme capable of initiating self-destructive reactions within the mine's explosive material. A stoichiometric excess of oxidizer is preferred for the full benefit of the invention to be realized, an aspect of the present invention which will be described more fully below.

Additional components of the system include materials or compounds that react with the metal prior to oxidation. In such a case, the reactants of the first reaction are subsequently oxidized. These reactive materials would include B (boron) and C (carbon), or combinations thereof. Moreover, by including, within the reactive metals, elements which exothermically form intermetallic reactants prior to oxidation, one can further increase target defeat through utilization of both primary (formation of intermetallic compound) and secondary (oxidation) reactions. As an example, where titanium, boron, and potassium perchlorate are present in the projectile as the reactive components, one sees:

$$Ti+2B \rightarrow TiB_2$$

which generates up to 1.2 kcal/gm and maximum temperatures of 3,500 K. These hot $TiB_2$ particles can then further react with the oxidizer:

$$TiB_2+(\text{excess})\ KClO_4 \rightarrow TiO_2+B_2O_3+KCl+(\text{remainder})\ KClO_4$$

The remainder $KClO_4$ ultimately decomposes to KCl and $2O_2$. This secondary reaction—the oxidation step—generates an additional 3–4 kcal/g which enhances and extends the exothermic effect useful in many military and civilian applications.

Although the materials which react with the metals to exothermically form intermetallic compounds can simply be dispersed within the reactive metal/oxidizer composition, it is preferred that the front section (e.g., the nose) of the projectile would contain the reactive metal and reactive material capable of exothermically forming the intermetallic compound, thereby causing the initiation of the reaction to begin at the front of the projectile and progress toward the rear as the projectile moves through the mine during the destruction event.

More specifically, in one embodiment of the present invention, a projectile for the destruction of unexploded ordnance is comprised of a shell having a single core region and a composite nose. Alternatively, the nose could be solid metal and the core region itself could be divided into two regions, a front section and a rear section. In either event, the nose or front section is comprised of a reactive composition comprising a first reactive metal and a reactive material capable of exothermically forming an intermetallic compound with the reactive metal, in accordance with the above description. The rear section (either the core region if the nose is the composite or the back half of the core region if the nose is solid metal and the front region is the composite) comprises an oxidizer and a second reactive metal which may be the same metal as said first reactive metal, or different. This embodiment allows for the exothermic formation of the intermetallic compound toward the front of the projectile upon impact, and subsequent oxidation as the projectile continues on its path through the unexploded ordnance.

Consistent with the projectile described above, a method of destroying unexploded ordnance is also included in the present invention. The method includes impacting unexploded ordnance with a reactive composition comprising a reactive metal and a reactive material capable of exothermically forming an intermetallic compound with said reactive metal, allowing the reactive metal and the reactive material to exothermically form an intermetallic compound, and then oxidizing the intermetallic compound in the presence of the unexploded ordnance to fully defeat the ordnance.

FIG. 1 shows a cross sectional view of a projectile in accordance with one of the embodiments described above. In this embodiment, projectile shell 100 carries reactive material 110 within its core region. Nose 120 is comprised of the reactive intermetallic composite described above (reactive metal and material capable of exothermically forming an intermetallic compound). Moreover, nose 120 can be comprised of any appropriate composition or composites of metals which react exothermically with the metal present in the core region.

FIG. 1 also shows fins 130 and 140. Generally, three fins are used to stabilize the projectile during flight. The fins are spaced 120 degrees from center if three are used. Of course, more can be used and one skilled in the art could determine the proper placement and number of fins for appropriate flight stabilization.

Figure 2:
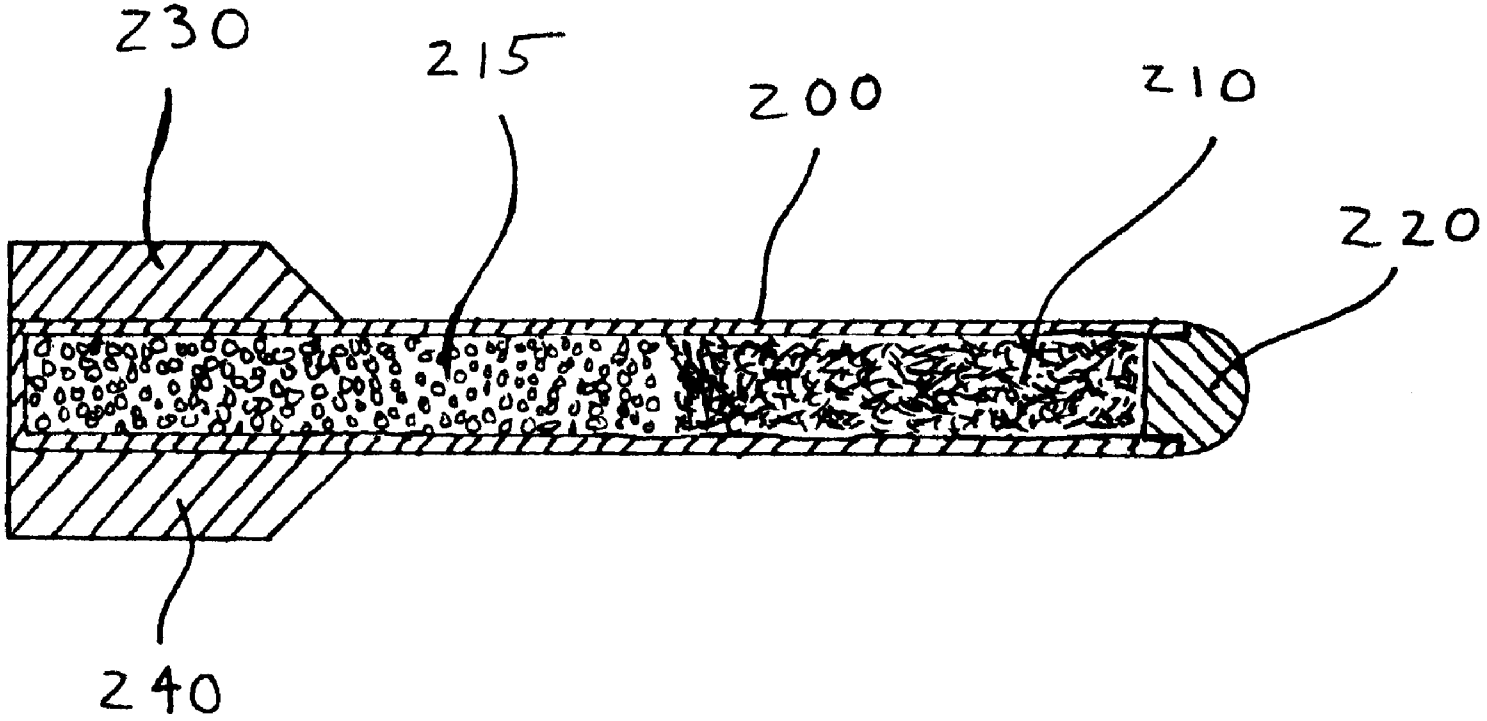
FIG. 2 is a cross sectional view of a second embodiment of the projectile according to the present invention.

FIG. 2 shows a related embodiment of the present invention. In this embodiment, nose 220 is solid metal, and could be chrome steel, steel, tungsten, or combinations thereof. The main criteria for selection of material of construction for the nose 220 in this embodiment is that it be hard and of a high density. Also shown in FIG. 2 is a two-part core region, consistent with the above description. Within projectile shell 200 is front section 210 which is comprised of a reactive metal and a material capable of reacting with the reactive metal to exothermically form an intermetallic compound. Rear section 215 is comprised of any of the above reactive metals and above-described oxidizers. Also shown are fins 230 and 240.

In addition to using the projectiles of the present invention for mine destruction, the projectiles have other uses. For example, the projectiles can be used for missile defense and other target destruction. Ballistic missiles, cruise missiles, aircraft, and land targets (such as armored personnel carriers, trucks, tanks, and buildings) can all be more easily destroyed through the use of the reactive material of the present invention. Another use includes breaching, or breaking into geologic stratas for military applications such as bunker defeat or commercial applications such as oil exploration. In such cases, the projectiles are used to remove debris from the target hole, a process typically referred to as "mucking".

Typically, the projectiles range in size from 3 inches in length to 7 or 8 inches in length, but other sizes would work. For land mine destruction, the projectile is usually between 3 and 6 inches in length, with a preferred embodiment being about 4.5 inches in length (4.3 to 4.7 inches). Larger projectile sizes up to 12 to 20 inches in length and 1 to 3 inches in diameter can be used for penetrating buildings and destroying their contents including chemical or biological agents or fuels by starting a fire in the building.

In order to launch the projectile from a gun, a sabot is often employed. A sabot is a term known to those skilled in the art. Generally, a sabot is a sleeve that fits around part or all of the projectile to achieve two desirable results. One, the sabot stabilizes the projectile as it travels through the gun barrel, which achieves better flight trajectory as the projectile leaves the gun. Two, the sabot forms a seal between the projectile and the inside of the gun barrel. This second aspect is desirable because the maximum amount of energy is applied to the projectile as it travels down the barrel—energy which would otherwise be lost around the sides of the projectile if not for the sabot. Once the projectile leaves the end of the muzzle, the sabot falls away and the projectile continues in its trajectory. Ordinary firearms such as rifles, however, can be used to deliver reactive projectiles, with or without fins.

Figure 3:
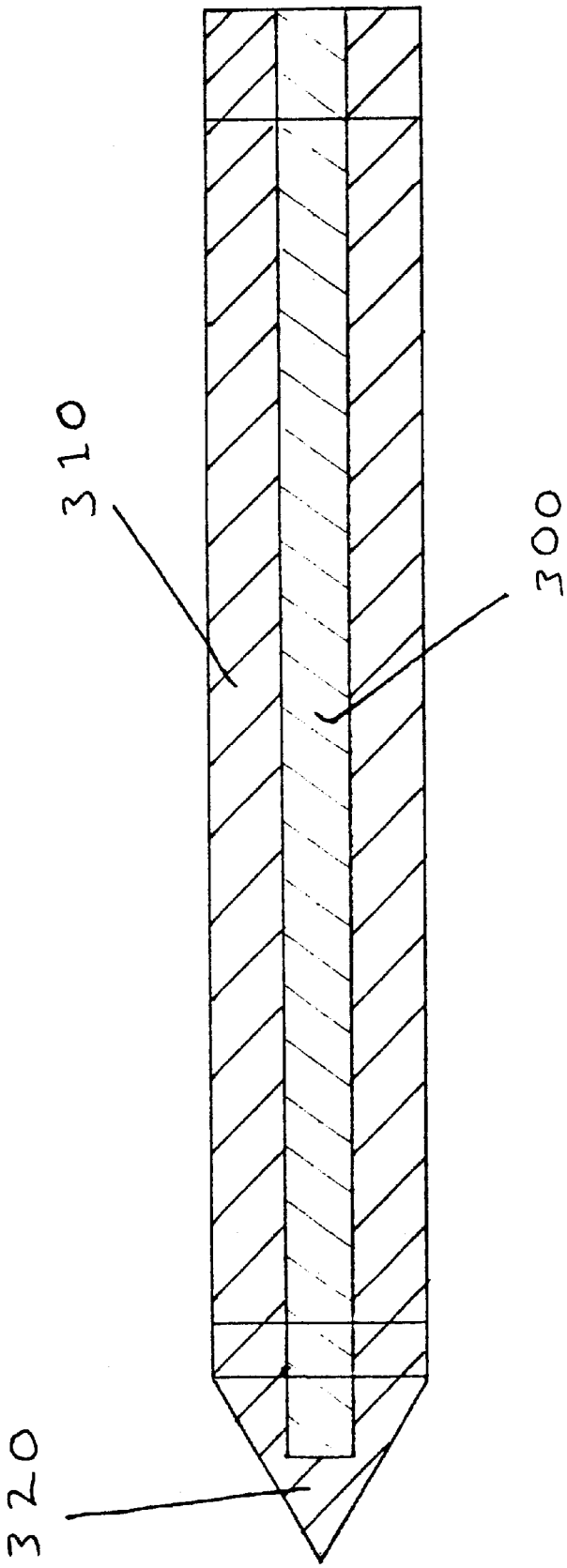
FIG. 3 is a cross sectional view of an alternative embodiment of the projectile according to the present invention.

FIG. 3 shows an alternative embodiment of the present invention where the reactive material is actually carried outside of a metal rod. This embodiment is a caseless projectile where a center penetrating rod carries the reactive material as a shell. Here, center penetrating rod 300 is comprised of steel, tungsten, or combinations thereof. Reactive shell 310 is the same material as described above for reactive material 110. Nose 320 can be any shape, such as rounded (as shown for nose 120) or cone shaped, and can be comprised either of chrome steel, steel, tungsten, or combinations thereof, or of a reactive intermetallic material. Nose 320 can be comprised of the same materials as those described above for nose 120.

Figure 4:
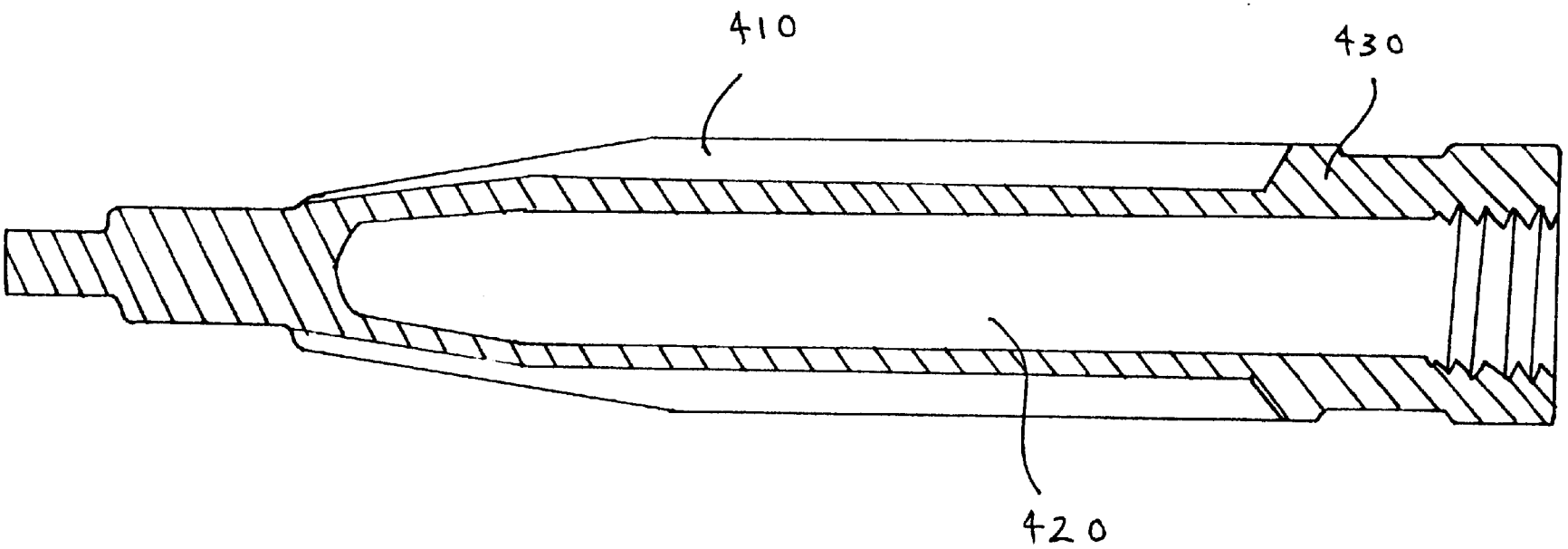
FIG. 4 is a cross sectional view of a bullet-like projectile with a cavitating nose for the defeat of sea mines.

The choice of nose shape depends upon the location of the mine for which destruction is desired. The design selected should provide superior penetration and destruction. The cone shaped nose 320 as shown in FIG. 3 is typically appropriate for penetrating sand or dirt. The rounded design, as shown in FIG. 1, is typically used where the mine for which destruction is sought is near or at the top of the ground level. A more "bullet shaped" body with a cavitating nose would be likely used where the projectile is used to destroy sea mines. One example of such a shape is illustrated in FIG. 4. In FIG. 4, bevels, or groove-like cavities 410 are present along the nose to aid in penetration through water. FIG. 4 also shows an embodiment where the reactive material 420 is contained within the nose 430. Moreover, the nose design is based on the medium (or "overburden") which must be penetrated in order to reach the target. Any of the nose configurations shown can be used with any of the embodiments disclosed herein.

Another embodiment of the present invention, especially suitable for use when the precise identity of the ordnance sought to be destroyed is unknown, is a two-component projectile. FIGS. 5*a*–5*c* show the steps of an event where a device according to the prior art is used in an attempt to destroy a metal land mine which is buried under soil. In this example, the device's ignition system is not robust enough to penetrate the overburden and detonate the metal mine. Specifically, as projectile 500 impacts overburden 510, the device explodes prematurely and fails to neutralize metal mine 520, leaving metal mine 520 in place as shown in FIG. 5*c*.

FIGS. 6*a*–6*c* show the result if a projectile having too robust an ignition setting is used against a plastic land mine. Here, projectile 600 impacts overburden 610, penetrates plastic mine 620 without detonating, and comes to rest when it runs out of momentum. Although this particular projectile may have ignited or exploded had it been used against a metal mine, it failed under the circumstances of the plastic mine.

Figure 7:
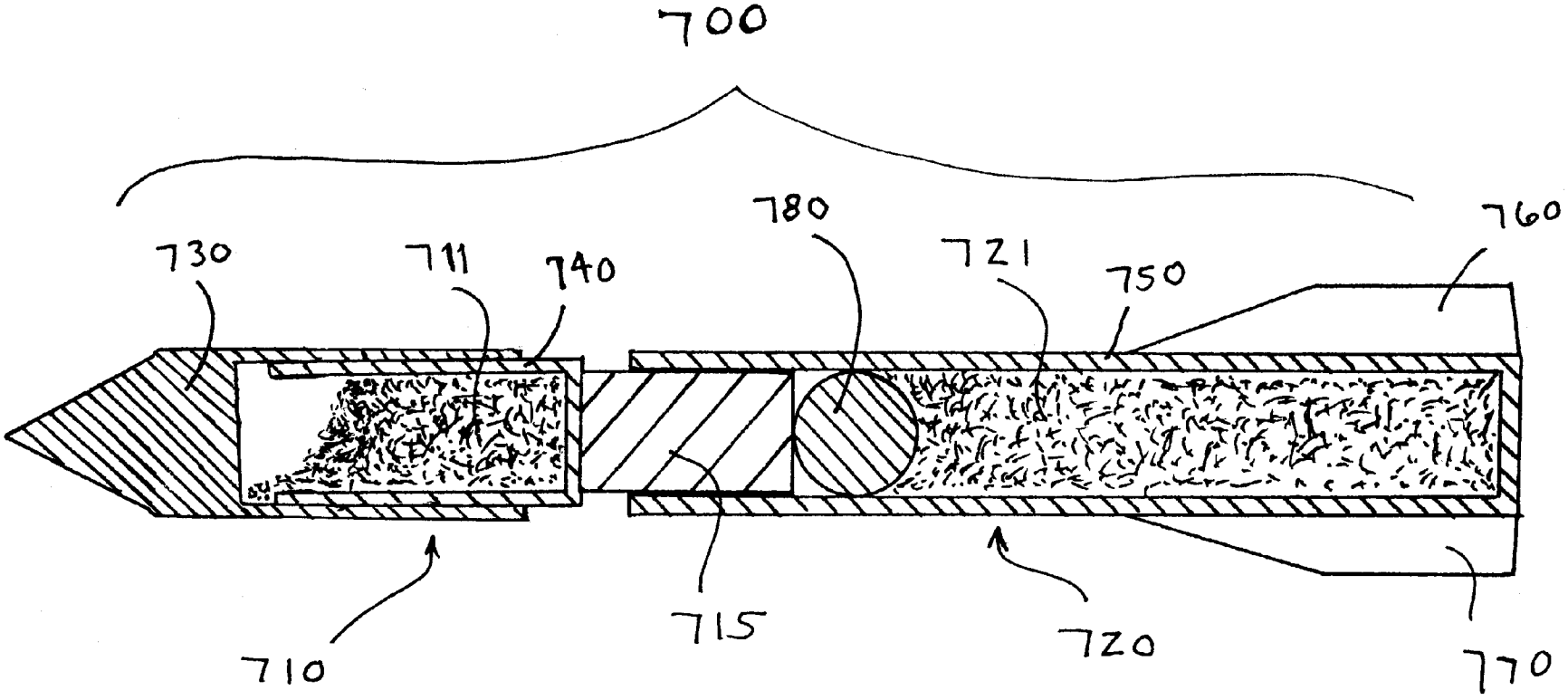
FIG. 7 is a cross sectional view of still yet another embodiment of the projectile according to the present invention.

Thus, an improved two-component system is provided as a part of the present invention which would successfully destroy either a plastic or metal mine. FIG. 7 shows a device in accordance with the present invention which can be used to destroy unexploded ordnance without regard to the material of construction of the ordnance. Specifically, this device has two sections, a head region comprising a first reactive composition and a body region disposed behind the head region comprising a second reactive composition and a body region ignition device. This configuration allows the initiation of an exothermic reaction or explosion in the rear of the projectile upon impact, prior to initiation of the exothermic reaction or explosion in the front of the device. This aspect is important to the defeat of mines where the construction of the mine is unknown, as discussed above.

More specifically, FIG. 7 shows projectile 700 which is comprised of two regions, a head region 710 and a body region 720. In this embodiment, head region 710 is attached to body region 720 by plunger 715, which is integrally attached to head region 710, and which is inserted into the front end of body region 720. Plunger 715 is either friction fit into the front of body region 720 or an adhesive (not shown) is used. In the preferred embodiment, both an adhesive as well as frictional forces are used to keep head region 710 connected to body region 720 via plunger 715.

Disposed within head region 710 and body region 720 are reactive compositions 711 and 721, respectively. These reactive compositions are the same as those described above, and include a reactive metal, a reactive material capable of exothermically reacting with said reactive metal to form an intermetallic compound, and an oxidizer. A binder, such as a fluorocarbon, waxes, or greases, may also be used to bind the reactive compositions. The particular reactive compositions may be the same in both regions, or may be different. For example, and consistent with that disclosed above, the body region may contain all three components (a reactive metal, a reactive material capable of exothermically reacting with said reactive metal to form an intermetallic compound, and an oxidizer), while the head region might contain only a reactive metal and oxidizer. This would allow the formation of the primary intermetallic compounds in the body region prior to reaction of the reactive composition in the head region.

This embodiment of the invention includes head cover 730 which is cuplike and fits over head cup 740 which houses reactive composition 711. Head cover 730 and head cup 740 are either friction fit, or an adhesive is used. Preferably, both adhesive and frictional forces are used to connect the two pieces. Body cup 750 houses reactive composition 721 and the rear section of plunger 715, as described above. Also included in a preferred embodiment are fins 760 and 770 to aid in aerodynamics.

As shown in FIG. 7, the body region also includes a body region ignition device, such as body sphere 780. Body sphere 780 is an ignition device which allows the transfer of energy upon impact when the projectile hits a target or overburden. Body sphere 780 may be simply a metal sphere, or may be comprised of an explosive material itself to further aid in deflagration. When enough energy is transferred through head cover 730, head cup 740, plunger 715, and sphere 780 into reactive mixture 721, the exothermic reaction of reactive mixture 721 begins. As the temperature rises during reaction of reactive mixture 721, the projectile continues its flight path and eventually reactive composition 711 reaches the point where it too will begin reacting exothermically. Thus, the overall effect is that the rear section, or body region, initiates first, followed by initiation of the front section, or head region. This is important for the reasons discussed above, and is described in more detail below.

The rate of delay of front ignition can further be controlled by changing the relative wall thicknesses of head cup 740 and body cup 750. Typically, the wall of the head cup 740 will be thicker than the wall of body cup 750. This relatively thicker wall thickness of the head cup means that a greater pressure is required to burst the head cup as compared to the body cup. This translates into a delayed deflagration in the head region as compared to the body region. This controlled rupturing can further be controlled by forming grooves in the wall, and deepening the grooves in those areas where quicker rupturing is desired (i.e. in the body region) as compared to shallower grooves where delayed rupturing is desired (i.e. in the head region).

Figure 8A:
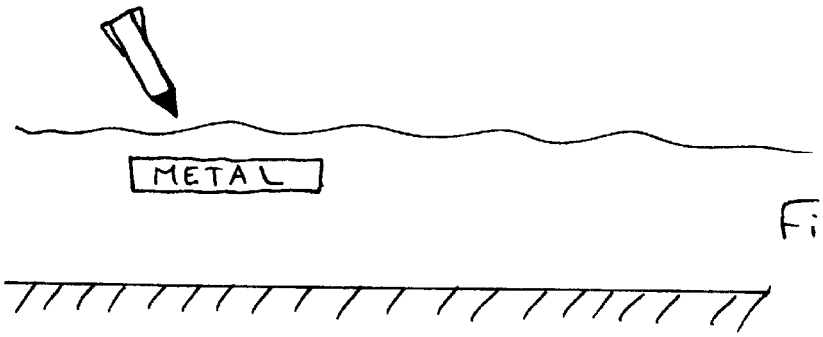
FIGS. 8*a*–8*d* are a representation of a series of progressive events when a projectile according to the present invention is used.
Figure 8B:
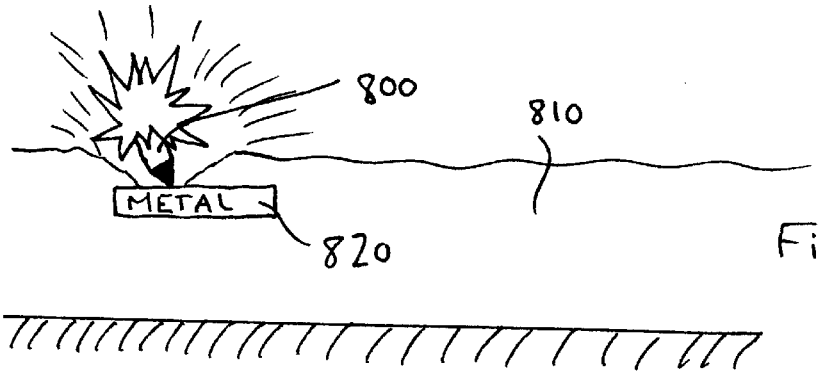
Figure 8C:
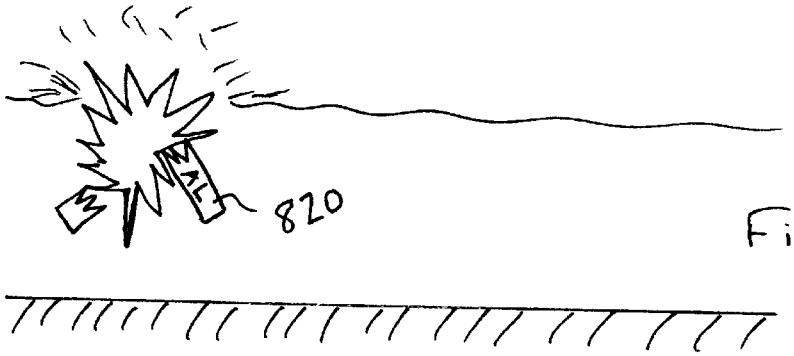
Figure 8D:
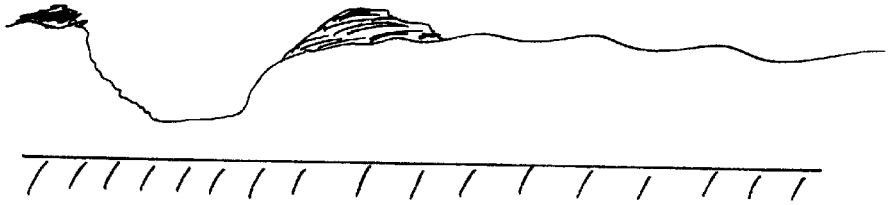

FIGS. 8*a*–8*d* show the effect of such a device on a metal mine. FIG. 8*b* shows projectile 800 impacting overburden 810 which causes the initiation of the explosion of the rear, body region of the projectile in accordance with the above description. Projectile 800 continues its flight path, however, because the head region has not yet broken apart, although the reactive composition within the head region has begun reacting. FIG. 8*c* shows the subsequent explosion of the remainder of the projectile now that it has reached metal mine 820, and the explosion of metal mine 820 as a result. FIG. 8*d* shows the result of the use of this projectile.

Figure 9A:
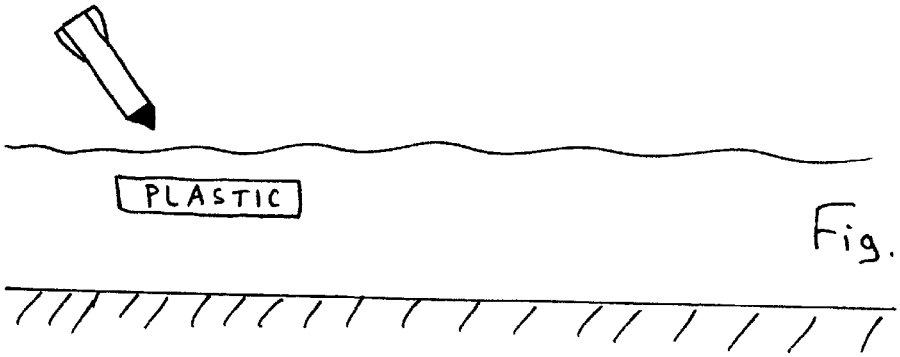
Figure 9B:
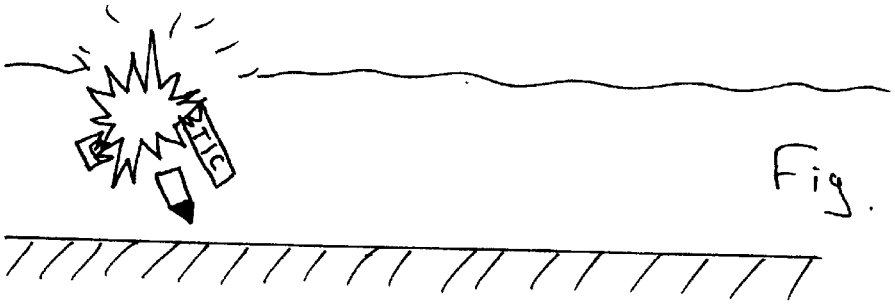
Figure 9C:
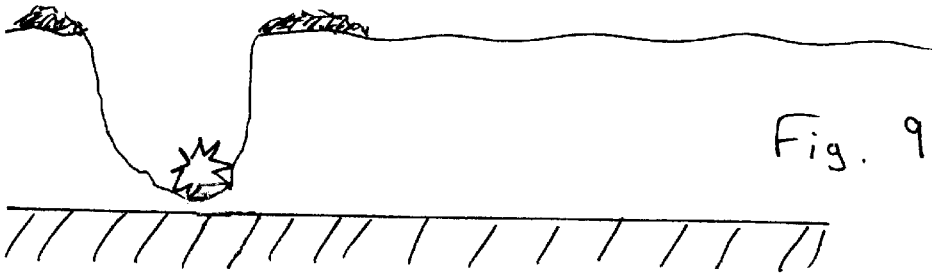
Figure 9D:
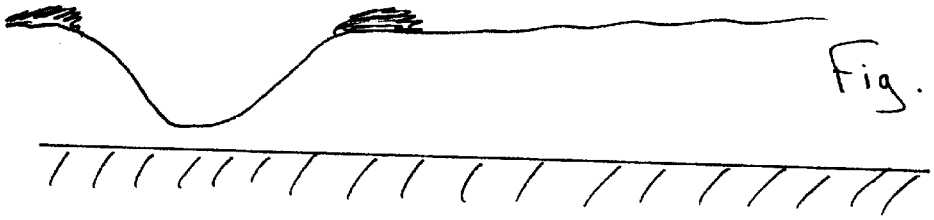

FIGS. 9*a*–9*d* show the use of the exact same device on a plastic mine. FIG. 9*b* shows the explosion of the rear, body region of projectile 800 as it impacts overburden 810. Because the plastic mine is relatively vulnerable (as compared to its steel cased counterpart), it will explode during reaction of the reactive composition in the rear, body portion. The head region will continue on its flight path and subsequently experience its full reaction, as shown in FIG. 9*c*. FIG. 9*d* shows the result of the use of this projectile.

Figure 10:
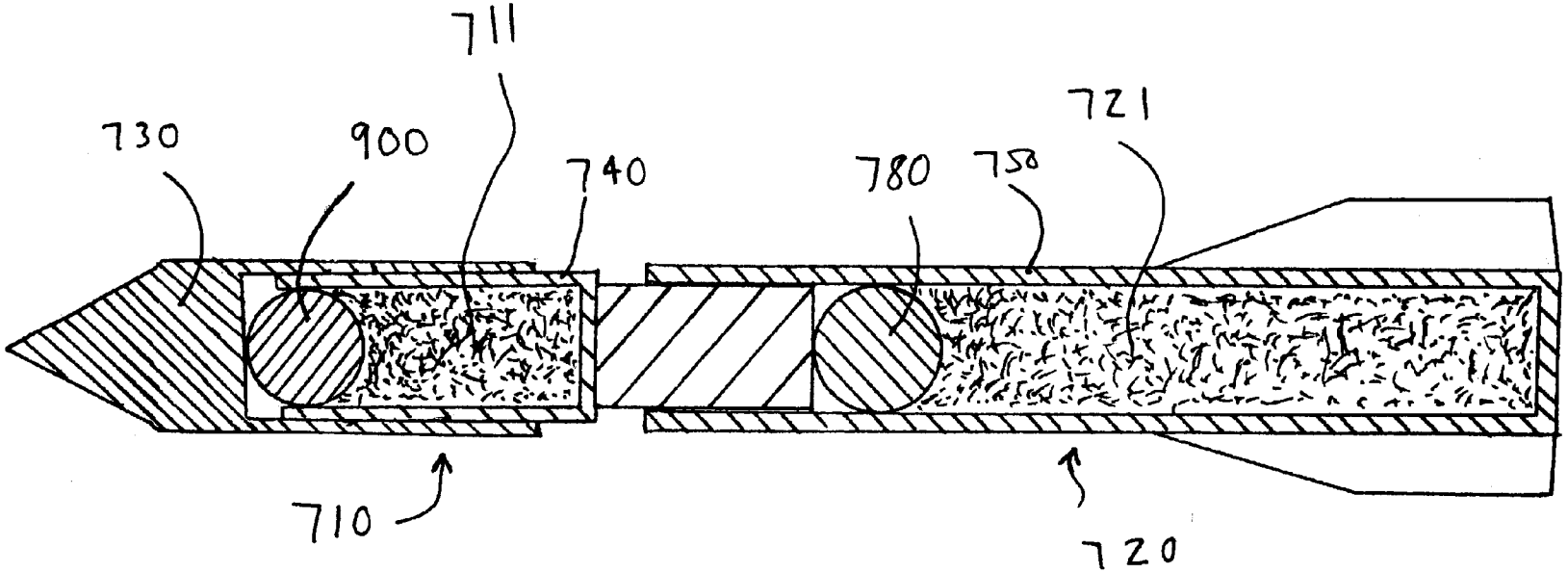
FIG. 10 is similar to the device shown in FIG. 7, but includes an additional ignition device.

Yet another embodiment of the projectile in accordance with the present invention is shown in FIG. 10. In this embodiment, a head cup sphere 900 is also present, in addition to body sphere 780. This second ignition device (head cup sphere 900), like its counterpart in the body (body sphere 780), causes a pinpointed delivery of energy upon impact to initiate the exothermic reaction of reactive composition 711. As discussed above, controlled rupturing between head cup 740 and body cup 750 is achieved through wall thickness control and grooves. The idea, as described above, is to achieve delayed front explosion as compared to rear end explosion, the later of which should occur relatively quickly after impact.

Figure 11:
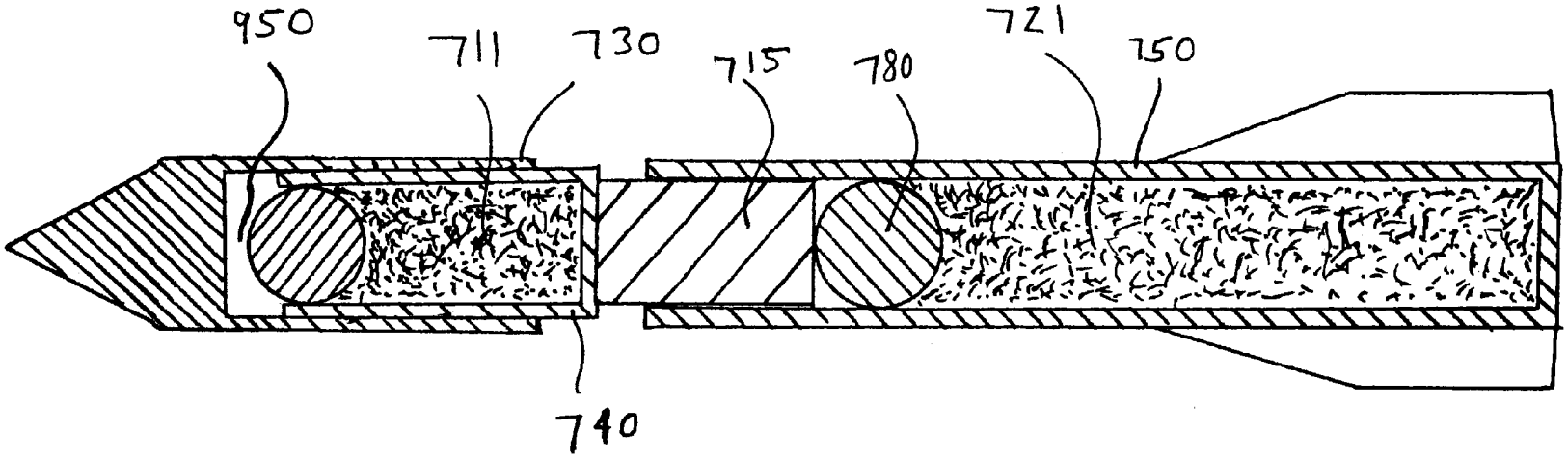
FIG. 11 is similar to the device shown in FIG. 10, but includes a headspace.

Still yet another embodiment is shown in FIG. 11, which is similar to the embodiment shown in FIG. 10, except that a headspace 950 is formed in front of head cup sphere 900. In this arrangement, energy is delivered virtually immediately to reactive composition 721 within body cup 750 upon impact through body sphere 780. Until sufficient impact force is experienced against head cover 730 so as to overcome adhesive and/or frictional forces between head cover 730 and head cup 740, however, little energy is delivered to reactive composition in head cup 740. Only after the projectile impacts a sufficiently hard obstacle, such as a steel mine casing or rock, will the adhesive and/or frictional forces holding head cover 730 to head cup 750 be overcome. This will allow rearward movement of head cover 730 with respect to head cup 750 and subsequent impact of head cover 730 against head cup sphere 900 to initiate the exothermic reaction of reactant composition 711 in head cup 740.

Use of the devices of the present invention for land mine defeat can be accomplished by shooting the projectiles of the present invention at a diagonal such that the gun (and the shooter, if the gun is not automated) is a safe distance from the mine. Typically, the projectiles of the present invention are fired from a 0.50 caliber gun or smaller. Another delivery mechanism, developed specifically for the projectiles of the present invention comprises a self-destructive, portable delivery system consisting of a hard fiber tube barrel and a wooden block containing the breech. This delivery system is a single shot apparatus and is electrically initiated from a safe, remote distance.

Figure 12:
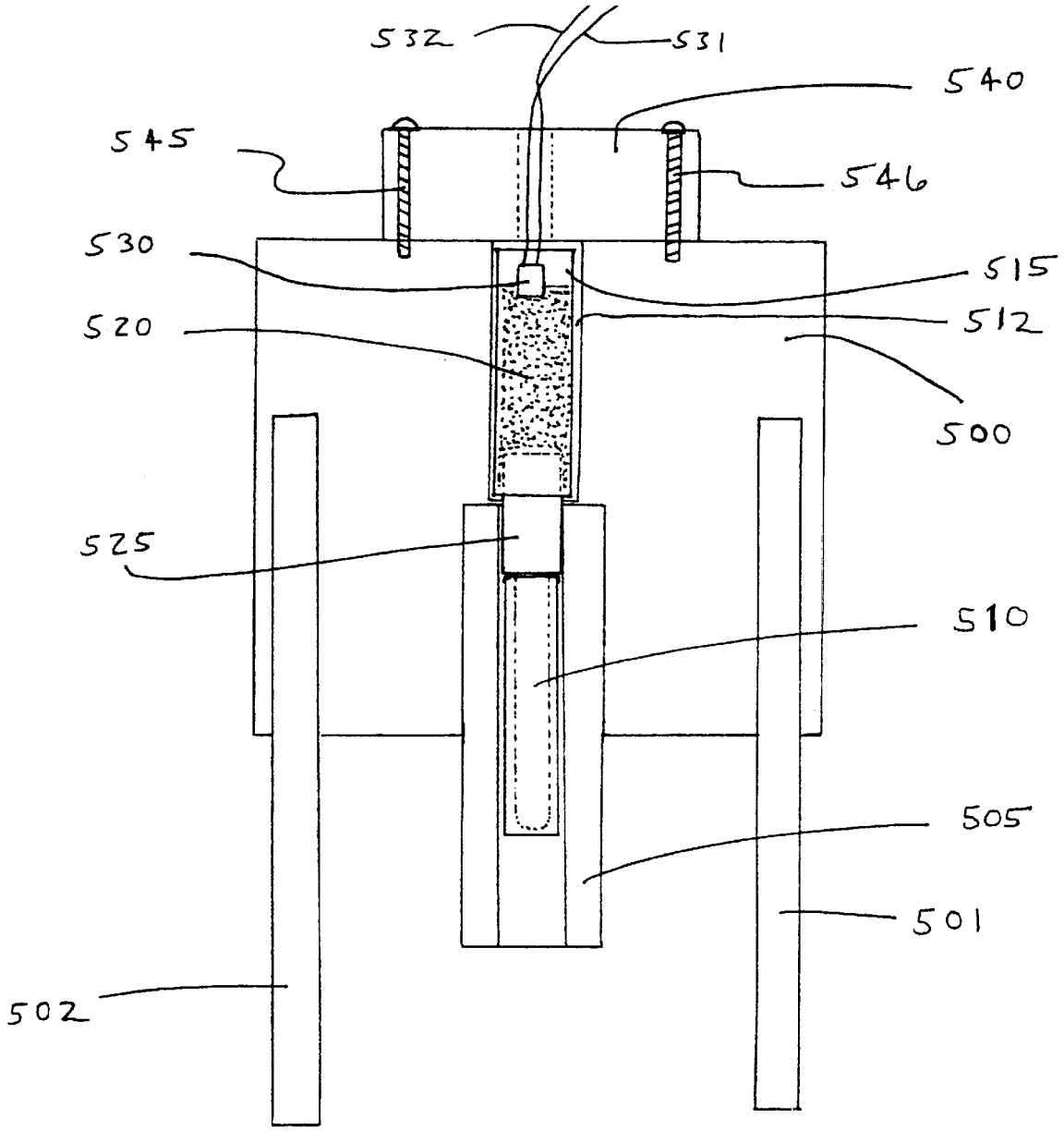
FIG. 12 illustrates an apparatus according to the present invention used to fire a projectile in accordance with the present invention.

FIG. 12 shows such a projectile delivery system for use in conjunction with the projectile of the present invention. The key to this aspect of the present invention is that the delivery system is comprised of materials other than metal. This delivery system is a one-time, disposable apparatus. It is destroyed along with the mine over which it is placed. As discussed above, any added metal debris or fragmentation is detrimental to the later detection of additional mines in the area because false positive readings are more likely to occur.

The projectile delivery system shown in FIG. 12 is only one example of the apparatus of the invention. As shown in the embodiment of FIG. 12, a wood block 500 with wooden legs 501 and 502 (shown) (more would normally be used) houses the barrel and breech. Barrel 505 is comprised of fiberglass or galvanized cellulose, among other suitable materials. The upper bore of barrel 505 contains the saboted projectile 510 which is the projectile of the present invention. Block 500 also contains a breech 515 (a cavity) in which shell 515 is situated above barrel 505. Shell 515 contains gunpowder 520, preferably black powder. Paper wad 525 keeps the powder 520 in shell 515 even when the saboted projectile is not present, as is the case up until the apparatus is about to be used.

An electrical priming device 530, often referred to as a squib, is located in the top of shell 515. Attached to priming device 530 are wires 531 and 532. This allows remote detonation, insuring that the user will be out of harm's way. Breech block 540 is screwed, using polymeric screws 545 and 546, onto the top of wooden block 500 after shell 515 is inserted.

One aspect to the use of the apparatus according to the invention is that the non-metallic device houses only the charge, without the projectile, until the device is ready to be used to destroy a mine. This precludes the accidental discharge of the explosive projectile. In a worst-case scenario, only a wad of paper is going to be expelled from the barrel. Typically, when a mine is located and destruction is desired, the device is loaded by inserting an appropriate projectile according to the present invention into barrel 505. The device is then placed atop the mine. The wires 531 and 532 are run to a safe distance and the mine can then be destroyed.

Another embodiment of a delivery system includes a disposable shell containing the reactive projectile and a propellant charge, with lead wires extending therefrom, suitable for connection to a charge source. The shell is disposed within a supported platform which together are placed over a target for which destruction is desired. An example of this embodiment is shown in FIGS. 13*a*–16.

Figure 13A:
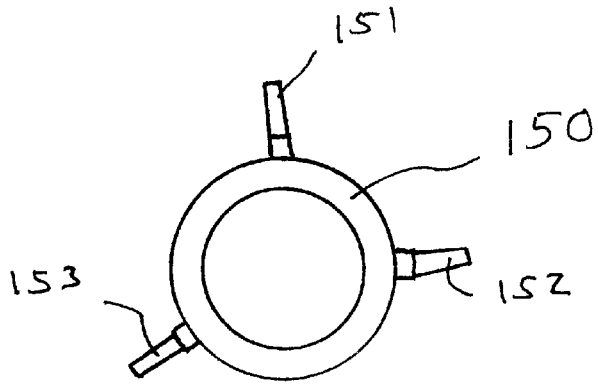
FIGS. 13*a* and 13*b* are a top view and side view, respectively, of a holding device according to the present invention.
Figure 13B:
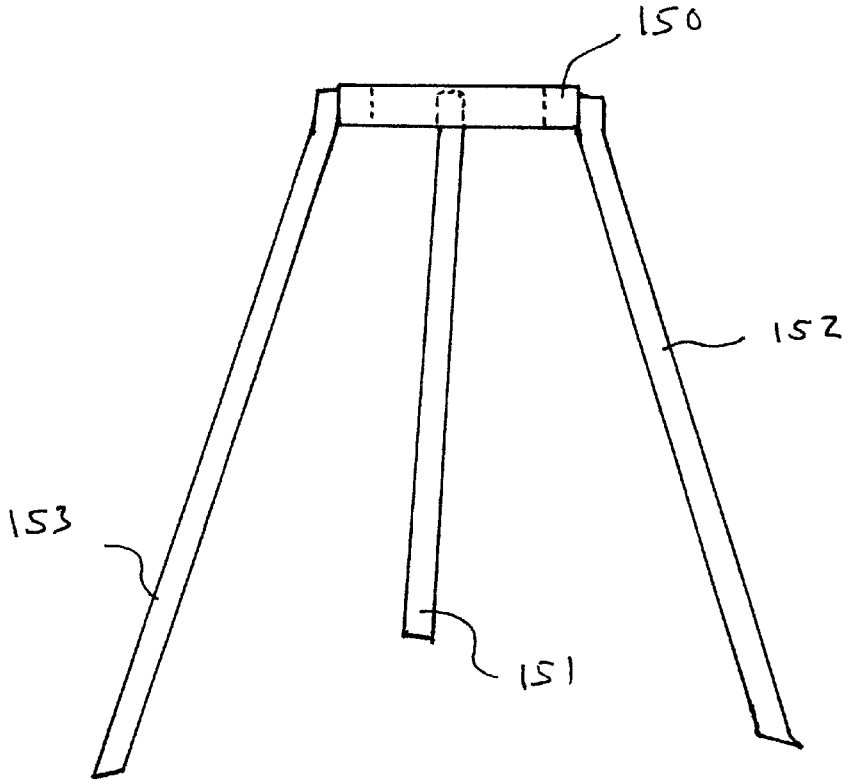

FIGS. 13*a* and 13*b* show an overhead and side view, respectively, of a holding device 180 used to suspend a reactive projectile firing device in accordance with this aspect of the present invention. Specifically, holding device 180 is comprised of platform 150 which is connected to at least three legs, 151, 152, and 153. More legs could be used, but three is preferred because of cost and stabilization on uneven ground such as is typically encountered in areas where mines are a problem. In this three-legged embodiment, the holding device is a tripod. The holding device can be constructed from any number of materials, including wood, fiberglass or galvanized cellulose, among other suitable materials. Platform 150 is typically a ring (a round disk with a hole disposed therein), but could be any other shape, including square or triangular. The important aspect of platform 150 is that its hole be large enough to accept the insertion of the barrel, but small enough that the suspension bracket (discussed below) does not pass therethrough.

Figure 14:
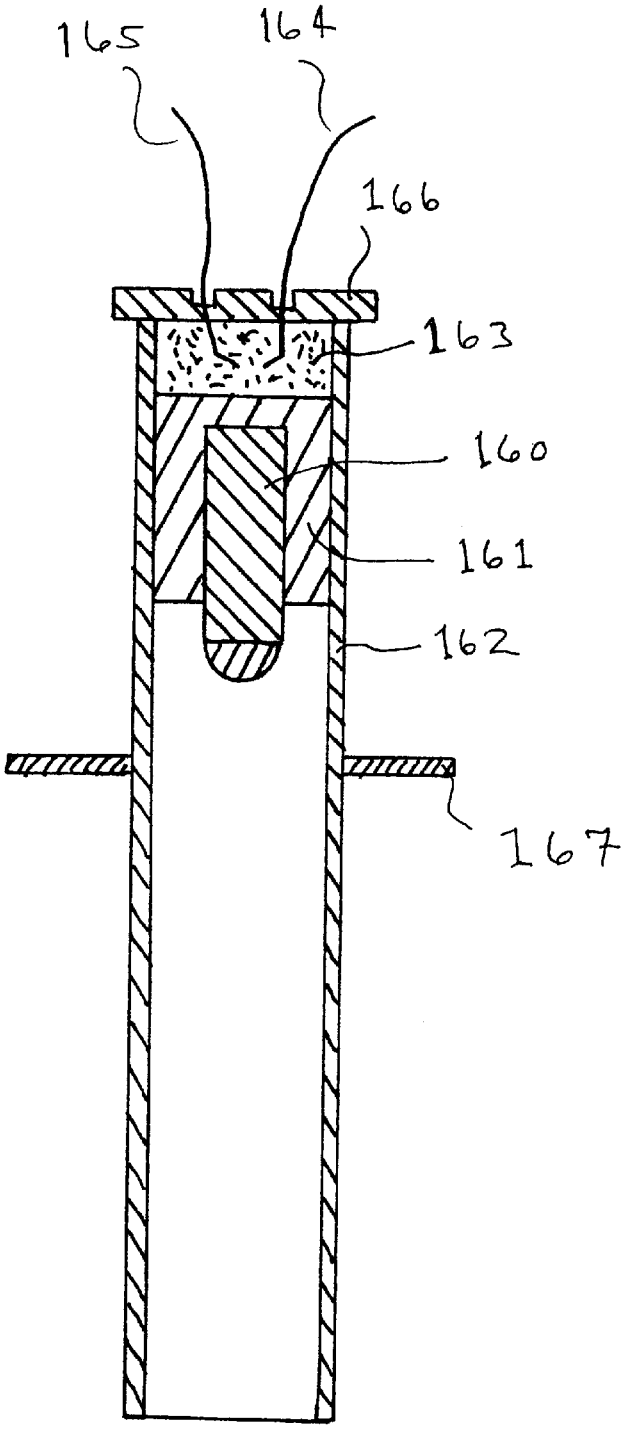
FIG. 14 shows a of a reactive projectile firing device in accordance with one embodiment of a launching device according to the present invention.

FIG. 14 shows an example of a reactive projectile firing device 190 containing an exemplary reactive projectile in accordance with the invention described above. More specifically, FIG. 14 shows reactive projectile 160 housed within a sabot 161, both of which are lodged within barrel 162. Propellant charge 163 is shown loaded behind sabot 161, and is in electrical communication with lead wires 164 and 165. Cap 166 is shown disposed at the end of barrel 162. Cap 166 may be integrally formed with barrel 162 or may be otherwise attached. Cap 166 may be formed of the same material as barrel 162, or may be formed from a different material. Typically, both cap 166 and barrel 162 are formed from fiberglass or galvanized cellulose, although they may be made from a suitable metal, as well.

Figure 15A:
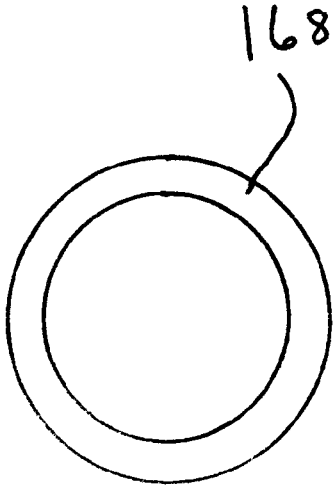
FIGS. 15*a* and 15*b* show two different versions of a suspension bracket in accordance with the device shown in FIG. 14.
Figure 15B:
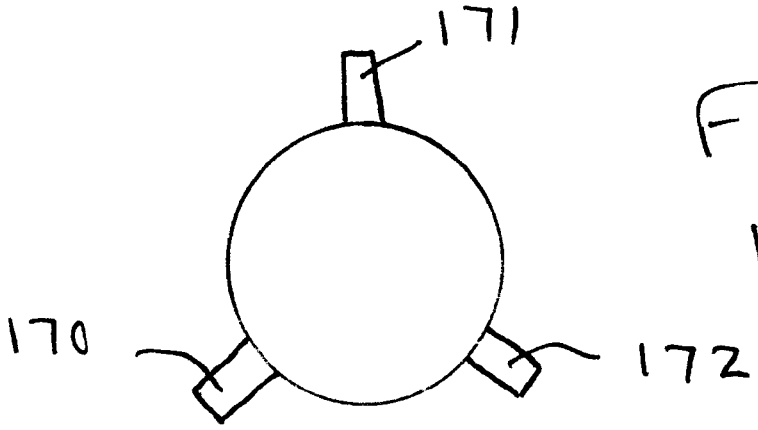

Suspension bracket 167 is also formed around barrel 162, and may be any type of extension which is suitable for holding the device within the holding device shown in FIG. 13*b*, for example. Suspension bracket 167 may be a disc-like extension 168, extending radially outward from barrel 162 as shown in the overhead view of FIG. 15*a*. In an alternative embodiment, however, as shown in FIG. 15*b*, suspension bracket 167 may be a plurality of arms, such as arms 170, 171, and 172, extending outwardly. Any suitable projection will work, so long as the device is capable of being held within the platform of the holding device as described above. Alternatively, the outside diameter of barrel 172 could be tapered outwardly from the bottom to the top, such that the device becomes suitably wedged within ring 150 of holding device 180 (not shown). It is important in this later embodiment, however, that the internal diameter of barrel 162 remain nearly constant along its entire length.

Figure 16:
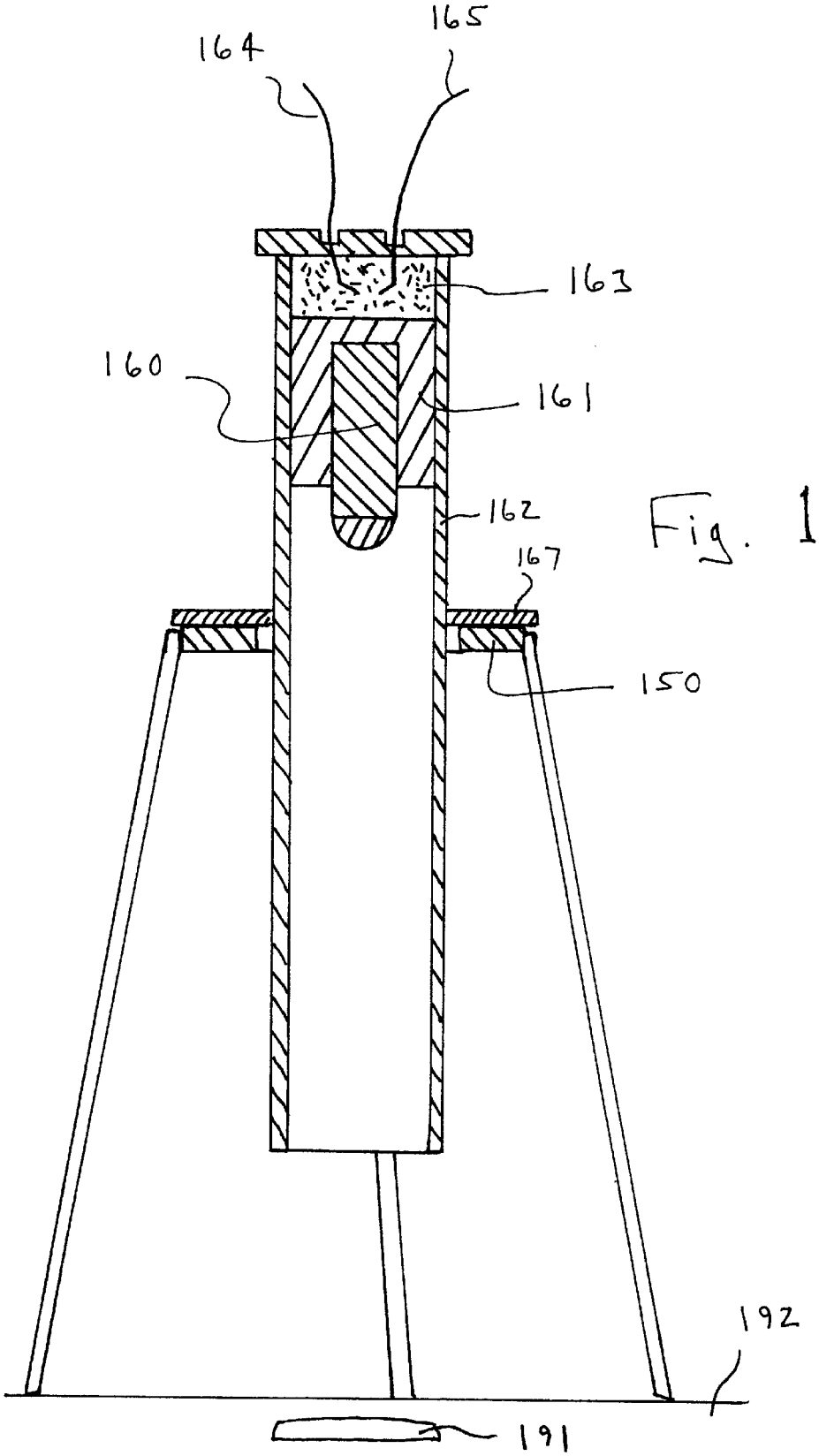
FIG. 16 shows a partial cross-sectional view of the devices of FIGS. 14 and 13*b* in place over a mine.

FIG. 16 shows holding device 180 with reactive projectile firing device 190 suspended therein over mine 191 which is buried within ground 192. The lead wires 164 and 165 would be attached to an electric ignition device which would be remotely activated so as to product a charge sufficient to ignite propellant charge 163 which then fires (expels) reactive projectile 160 (housed within a sabot 161) down barrel 162 and into ground 192 and ultimately mine 191. This device can be used with any of the reactive projectiles described above in accordance with this invention.

Figure 17:
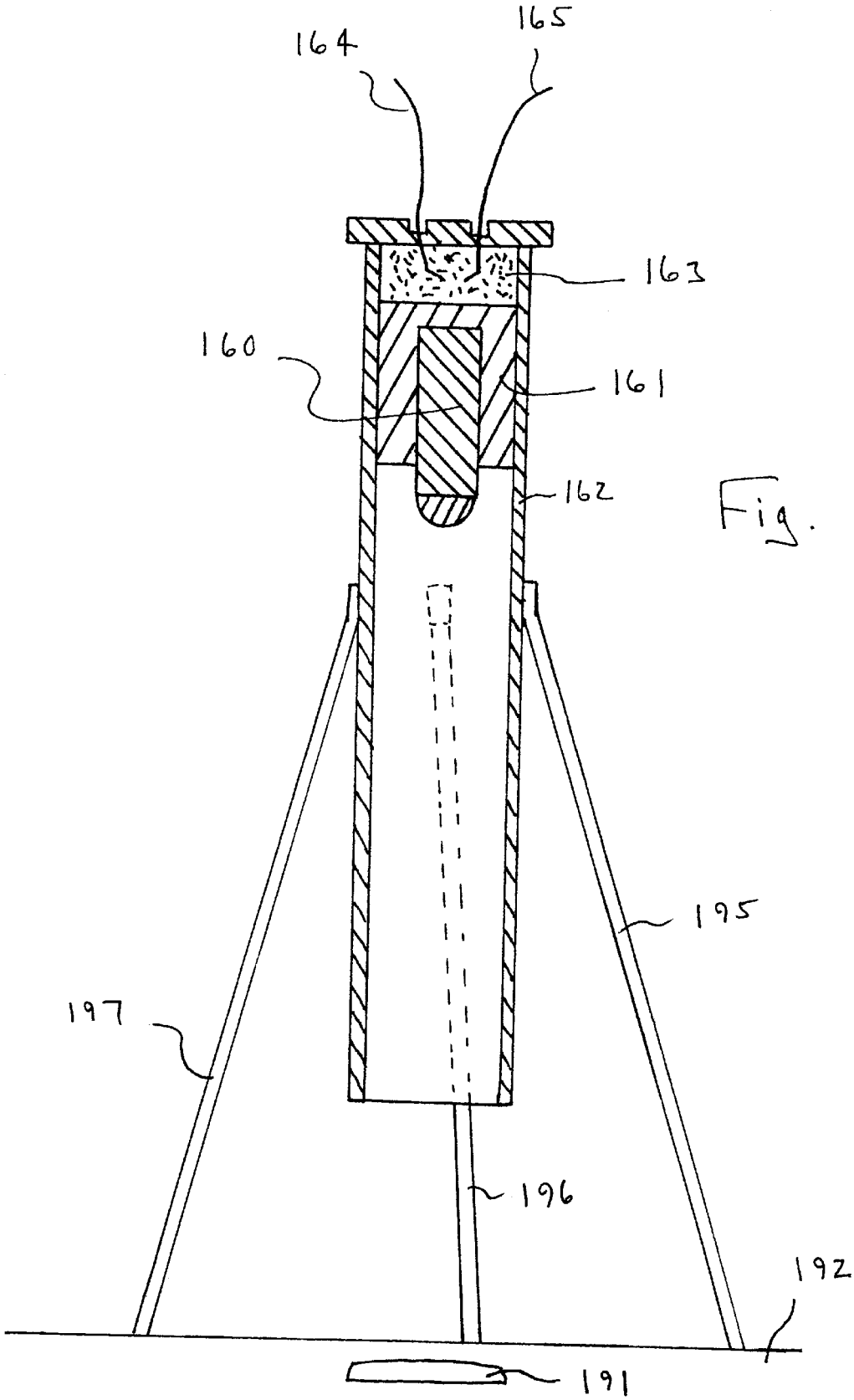
FIG. 17 shows a partial cross-sectional view of an alternative embodiment of that shown in FIG. 16 wherein three legs are each attached, individually, to the barrel.

FIG. 17 shows an alternative to the embodiment shown in FIG. 16, wherein the legs are mounted directly to the outside of barrel 162. This embodiment is simpler in that it does not require a platform or suspension bracket as described above. In this case, legs 195, 196, and 197 are attached, via any appropriate means, such as adhesives, welds, or mechanical means, to the barrel itself. The legs may extend directly down the side until the reactive projectile firing device is ready to be placed atop an unexploded mine, at which time the legs can be bent outward or otherwise extended radially outward so as to support the reactive projectile firing device over the mine. The key is that the legs extend beyond the barrel end so as to created sufficient height over the ground atop which the device is placed.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A projectile for the destruction of unexploded ordnance comprising:

a head region comprising a first reactive composition; and a body region disposed behind said head region comprising a second reactive composition and a body region ignition device;

wherein said body region explodes upon impact before said head region explodes.

2. The projectile of claim 1 wherein said head region further comprises a head region ignition device.

3. The projectile of claim 1 wherein said first and second reactive compositions each comprises a reactive metal, a reactive material capable of exothermically reacting with said reactive metal to form an intermetallic compound, and an oxidizer.

4. The projectile of claim 3 wherein said reactive material is one or both of: boron and carbon.

5. The projectile of claim 3 wherein said reactive metal is selected from the group consisting of: titanium, aluminum, magnesium, lithium, beryllium, zirconium, thorium, uranium, hafnium, alloys thereof, hydrides thereof, and combinations thereof.

6. The projectile of claim 3 wherein said oxidizer is selected from the group consisting of: lithium perchlorate, lithium chlorate, magnesium perchlorate, magnesium chlorate, ammonium perchlorate, ammonium chlorate, potassium perchlorate, potassium chlorate, oxides thereof, peroxides thereof, and combinations thereof.

* * * * *